US008261649B2

(12) United States Patent
Fitzpatrick et al.

(10) Patent No.: US 8,261,649 B2
(45) Date of Patent: Sep. 11, 2012

(54) CHARGING HANDLE FOR AUTOMATIC RIFE

(75) Inventors: Richard M. Fitzpatrick, Longmont, CO (US); Brian L. Nakayama, Lakewood, CO (US); Eric S. Nakayama, Broomfield, CO (US)

(73) Assignee: Magpul Industries Corp., Boulder, CO (US)

( * ) Notice: Subject to any disclaimer, the term of this patent is extended or adjusted under 35 U.S.C. 154(b) by 94 days.

(21) Appl. No.: 11/673,555

(22) Filed: Feb. 9, 2007

(65) Prior Publication Data

US 2011/0226120 A1 Sep. 22, 2011

(51) Int. Cl.
*F41A 7/02* (2006.01)

(52) U.S. Cl. ..... 89/1.4; 89/1.42

(58) Field of Classification Search ..... 89/1.4, 89/1.42

See application file for complete search history.

(56) References Cited

U.S. PATENT DOCUMENTS 3,225,653 A * 12/1965 Packard ..... 89/1.4
6,311,603 B1 * 11/2001 Dunlap ..... 89/1.4
7,240,600 B1 * 7/2007 Bordson ..... 89/1.4
7,832,322 B1 * 11/2010 Hoel ..... 89/1.4

* cited by examiner

*Primary Examiner* — Stephen M Johnson
(74) *Attorney, Agent, or Firm* — Geoffrey E. Dobbin

(57) ABSTRACT

The present invention is a charging handle for an automatic, bolt actuated rifle. The handle features a ratcheting retraction assist and blowback diversion structures.

5 Claims, 4 Drawing Sheets

CHARGING HANDLE FOR AUTOMATIC RIFE

FIELD OF THE INVENTION

The field of the present invention is an automatic rifle and more particularly relates to a charging handle for the same.

BACKGROUND OF THE INVENTION

The use of bolt operated automatic and semi-automatic rifles is widespread and in all military and law-enforcement environments. Under normal operating conditions, a user can manually retract the bolt carrier group of such rifles by pulling back on the charging handle in order to load the rifle or to clear stoppages. However, certain malfunctions require the user to retract the bolt carrier group with additional force beyond what is necessary for normal operation. Unfortunately, there are neither any features integral to the M16 system nor are there any aftermarket solutions that allow for additional mechanical advantage to be applied in such circumstances. Standard techniques for clearing such a malfunction require the user to remove the rifle from the shoulder and strike the butt of the rifle against a firm surface while simultaneously hitting, unlocking and retracting the charging handle. This technique requires physical dexterity and greatly reduces the tactical awareness of the user.

Additionally, the use of sound suppression devices was apparently not heavily considered during the development of the M16 system. These devices increase the duration of the pressure spike of combustion gasses and often times force excess gas around the charging handle and directly into the face of the user. There is currently an aftermarket replacement part (the GAS BUSTER by Precision Reflex Inc.) that mitigates this problem for a right-handed user. However, this design does not allow for additional mechanical leverage and directs some gas through the right-hand side of the rifle towards a left-handed operator's eyes and face.

Finally, there are reports of the charging handle failing under extreme usage. Although the exact nature of these failures is not specified, it is most likely that these failures occur when the charging handle is in the extended position and then subjected to excessive lateral or upward forces. This could bend the charging handle enough to prevent the bolt carrier group from closing. In this scenario, the rifle becomes completely inoperable until the charging handle can be removed, replaced or possibly bent back into place (which may cause a full breakage). In this case, it is possible for the rifle to function without a charging handle but the rifle's usability and operational abilities become extremely hindered.

What is required, therefore, is a new replacement assembly or assemblies that will integrate mechanical advantage bolt retraction and gas-blowback diversion to the M16 Rifle Series. Additionally, the new assembly should seamlessly integrate into the M16/M4 platform, function ergonomically and safely, be unobtrusive, not impair the user in any way and operate in all military and law-enforcement environments. Specifically, such a replacement assembly should be able to increase the speed and ease of clearing jams such as a stuck case, stuck bolt, live round double-feed, empty case double-feed (i.e. ejection failure), certain failures to extract, and even case head separation, possibly with the assistance of a broken shell removal device in this later scenario.

SUMMARY OF THE INVENTION

In view of the foregoing disadvantages inherent in the known charging handles, this invention provides an improved charging handle providing both mechanical advantage and gas diversion structures. As such, the present invention's general purpose is to provide a new and improved charging handle that will be easily actuated, provide greater leverage and force for the removal of jams within the weapon and divert gas blowback away from the face of a user.

To accomplish these purposes, the charging handle according to the present invention provides two gas diversion sections built within the very structure of the handle, one at a forward end and one toward a distal end, near the user's face. The structures are designed to generate turbulence in the gas flow and prevent blow back into a user's face. Secondarily, the handle also provides a leveraged latching handle that ratchets the charging handle through a primary retraction zone in the weapon and also provides a primary appendage for use in retracting the handle through a secondary retraction zone. The handle should also be mage stronger, to withstand both lateral and upward sheer forces when extended and help prevent bending and disfigurement of the handle while in this exposed stage.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the enhanced charging handle is herein described. It should be noted that the articles "a", "an" and "the", as used in this specification, include plural referents unless the content clearly dictates otherwise.

Figure 1:
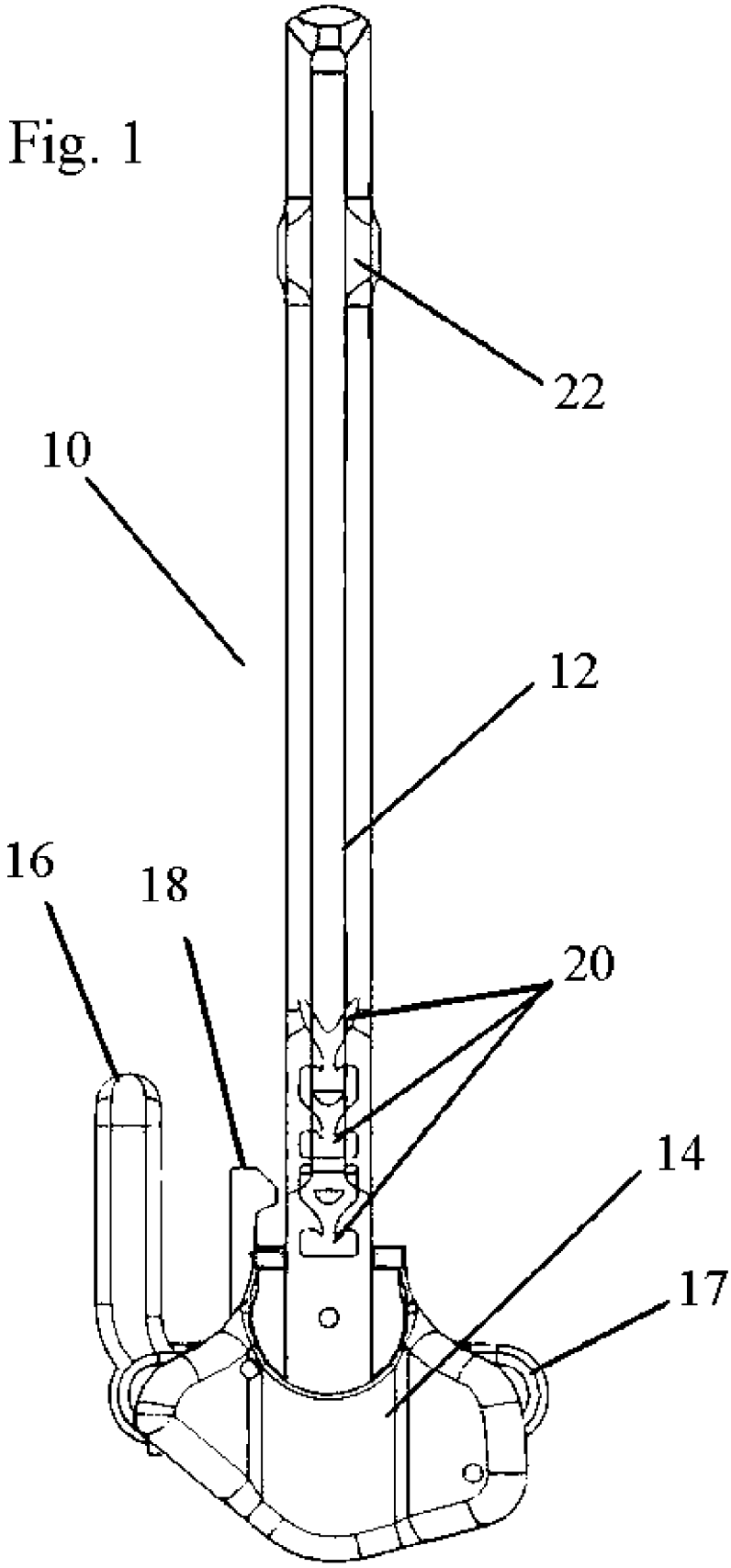
FIG. 1 is a top plan view of a charging handle according to the present invention.
Figure 2:
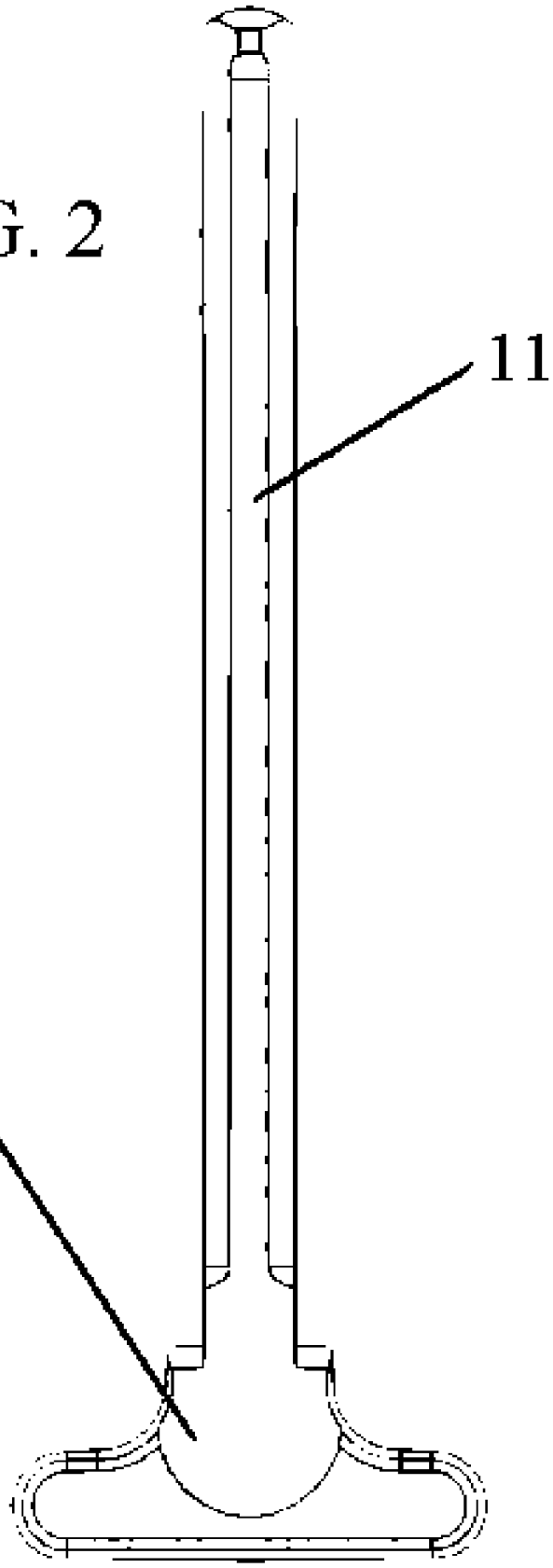
FIG. 2 is a top plan view of a charging handle according to the prior art.
Figure 3C:
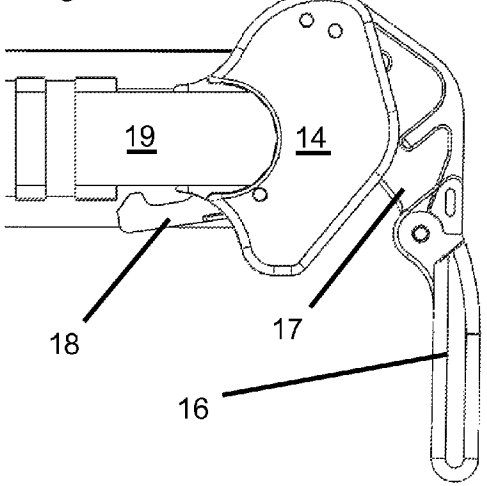
FIGS. 3*a* -3*d* are successive top plan views of the charging handle of FIG. 1 being retracted from a rifle receiver.
Figure 3B:
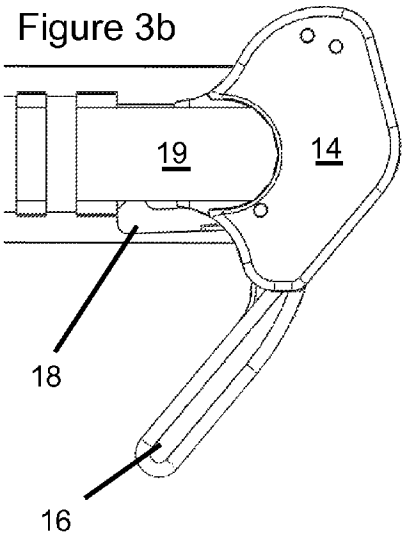
Figure 3A:
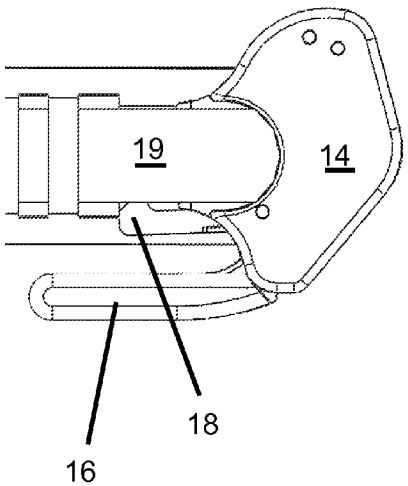
Figure 3D:
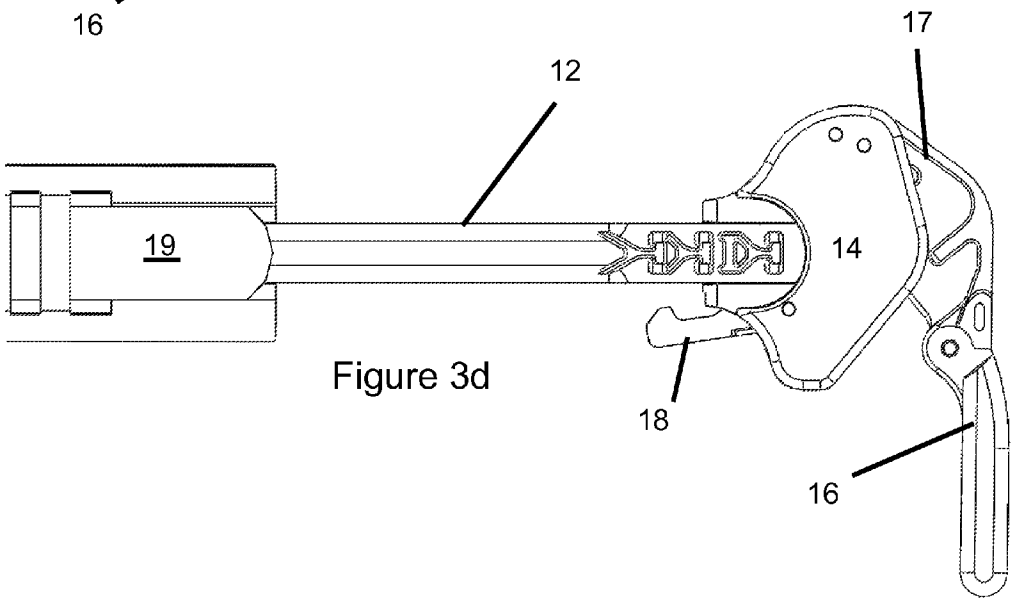
Figure 4:
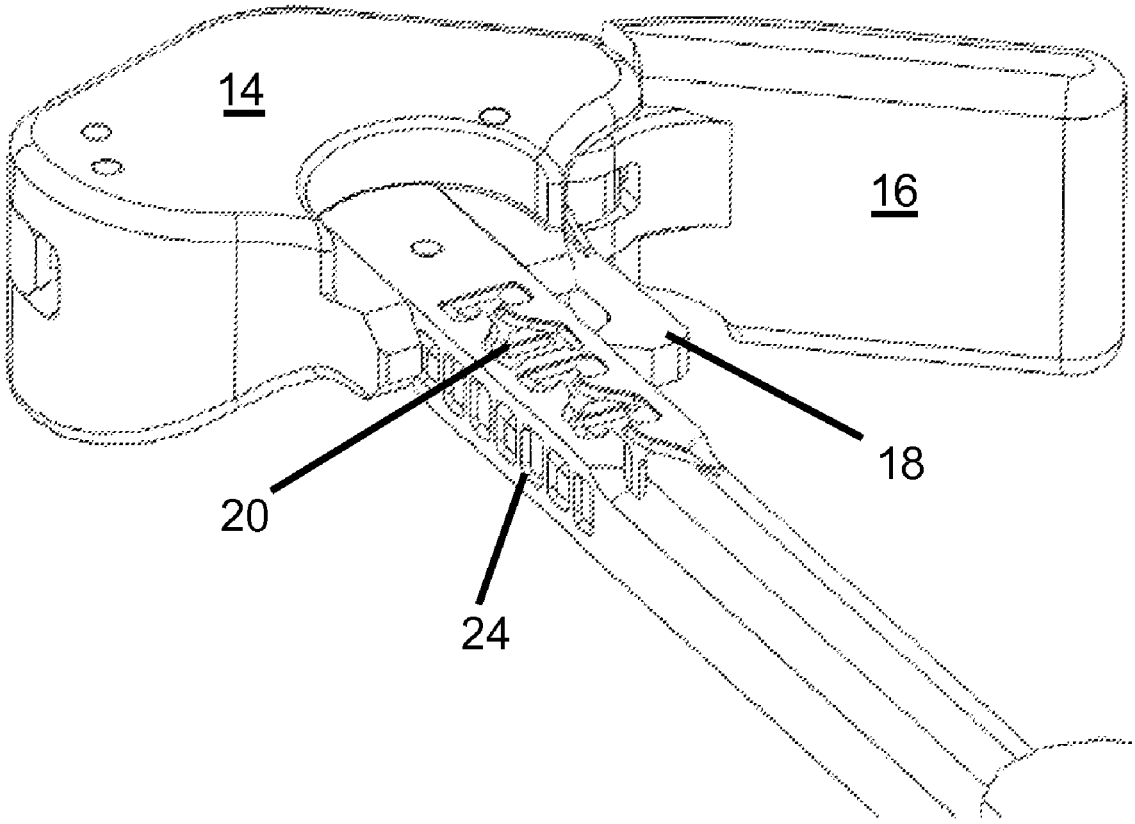
FIG. 4 is a perspective view of the charging handle of FIG. 1.

Referring to FIGS. 1 and 2 the charging handle 10 is initially comprised of a shaft 12 with a bolt connector (not shown) at one end and a backstop 14 at the other. The bolt connector is the interface with the bolt carrier group within the rifle, while the backstop 14 is the portion viewable outside the rifle. Shaft 12 is ideally hemispherically hollowed on the underside, with gas diversion means located underneath housing 22. Turbulence induction grooves 20, 24 (shown in FIG. 4) are proximate backstop 14 and assist in diverting gas generated from firing the rifle. Attached to backstop 14 is lever 17, which is, in turn connected to pivoting retraction handle 16 and latch 18.

As shown In FIGS. 3*a*-3*d*, the handle 10 is installed within the upper receiver 19, with backstop 14 located over buffer tube/butt stock combination. pivoting retraction handle 16 is then parallel with the upper receiver 19. Pivoting retraction handle 16 is drawn backwards to a point where it is perpendicular with upper receiver 19, which likewise draws lever 17, and the attached shaft 12, away from the upper receiver 19. This levering provides the mechanical assist to more efficiently clear jams in the weapon. Simultaneously, lever 17 draws latch 18 away from the upper receiver, where it maintained further contact necessary to secure the handle 10 to the weapon. The additional drawing of latch 18, frees the handle 10 for lateral movement with the attached bolt carrier group, within the upper receiver 19. At this point, pivoting refraction handle 16 serves as an additional appendage to ergonomically draw the handle 10 back.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A charging handle for a bolt-actuated automatic rifle comprising:

a. a hollowed shaft, with two opposite ends, further comprising a plurality of turbulence induction grooves proximate one end;

b. a backstop on the shaft end proximate the turbulence induction grooves;

c. a lever pivotably and cantileverally attached by one end of the lever to one side of the backstop such that the lever is stowed under the backstop and extends generally away from the end of the hollowed shaft opposite the backstop when actuated;

d. a pivoting retraction handle cantileverally mounted on an end of the lever opposite the end attached to the backstop; and, e. a latch coupled to the lever on the same end as the pivoting retraction handle;

wherein the pivoting retraction handle, when actuated, rotates the lever out from underneath the backstop and, in turn, the lever moves the latch from a closed position to an open position.

2. the charging handle of claim 1, the turbulence induction grooves being located on a top side of the hollowed shaft.

3. The charging handle of claim 2, the turbulence induction grooves also being located upon at least one lateral side of the hollowed shaft.

4. The charging handle of claim 1, the turbulence induction grooves being located on at least one lateral side of the hollowed shaft.

5. A charging handle for a bolt-actuated automatic rifle comprising:

a. a hollowed shaft, with two opposite ends;

b. a backstop located on one of the shaft ends;

c. a lever pivotably and cantileverally attached by one end of the lever to one side of the backstop such that the lever is stowed under the backstop and extends generally away from the end of the hollowed shaft opposite the backstop when actuated;

d. a pivoting retraction handle cantileverally mounted on an end of the lever opposite the end attached to the backstop; and e. a latch coupled to the lever on the same end as the pivoting retraction handle;

wherein the pivoting retraction handle, when actuated, rotates the lever out from underneath the backstop and, in turn, the lever moves the latch from a closed position to an open position.

* * * * *